US009867433B1

(12) United States Patent
Robertson et al.

(10) Patent No.: US 9,867,433 B1
(45) Date of Patent: Jan. 16, 2018

(54) BUTTON HOLDER FOR USE WITH PIN-BACK BUTTONS

(71) Applicants: Stephen Lynn Robertson, Surprise, AZ (US); Stephen Allen Robertson, Surprise, AZ (US)

(72) Inventors: Stephen Lynn Robertson, Surprise, AZ (US); Stephen Allen Robertson, Surprise, AZ (US)

( * ) Notice: Subject to any disclaimer, the term of this patent is extended or adjusted under 35 U.S.C. 154(b) by 0 days.

(21) Appl. No.: 14/990,705

(22) Filed: Jan. 7, 2016

Related U.S. Application Data

(60) Provisional application No. 62/100,886, filed on Jan. 7, 2015.

(51) Int. Cl.

| | |
|---|---|
| ***A44C 3/00*** | (2006.01) |
| ***A44B 1/18*** | (2006.01) |
| ***A44B 1/04*** | (2006.01) |
| ***A44B 1/14*** | (2006.01) |

(52) U.S. Cl.
CPC ..... *A44C 3/001* (2013.01); *A44B 1/04* (2013.01); *A44B 1/14* (2013.01); *A44B 1/18* (2013.01)

(58) Field of Classification Search
CPC .... A44B 1/04; A44B 1/14; A44B 1/18; A44C 3/001; A44C 3/00
USPC ..... 63/1.18, 20, 40; 40/1.5, 661.04
See application file for complete search history.

(56) References Cited

U.S. PATENT DOCUMENTS

| | | | | |
|---|---|---|---|---|
| 1,490,624 | A * | 4/1924 | Mitchel | A44C 3/001 40/1.5 |
| 4,989,352 | A * | 2/1991 | Seppanen | G09F 3/12 24/706.2 |
| 7,596,966 | B2 * | 10/2009 | Garvin | A44C 17/0216 63/1.16 |
| 2010/0075073 | A1 * | 3/2010 | O'Byrne | A44C 5/0007 428/14 |

* cited by examiner

*Primary Examiner* — Abigail Troy
(74) *Attorney, Agent, or Firm* — IPTechLaw

(57) ABSTRACT

Implementations of button holders may include: a planar portion having a hole therethrough, one or more flanges configured to receive a pin-back button, the one or more flanges located around at least a portion of a perimeter of the hole on opposing sides of the hole and a messaging portion coupled on the planar portion above, below, or both above and below the hole. The flanges may be configured to removably couple to the button through a friction fit. The hole may be configured to allow a pin of the pin-back button to be accessible through the hole by a user to allow the pin to couple to user's clothing.

2 Claims, 3 Drawing Sheets

BUTTON HOLDER FOR USE WITH PIN-BACK BUTTONS

CROSS REFERENCE TO RELATED APPLICATIONS

This document claims the benefit of the filing date of U.S. Provisional Patent Application 62/100,886, entitled "Pin-back Button Shield" to Stephen L. Robertson and Stephen A. Robertson which was filed on Jan. 7, 2015, the disclosure of which is hereby incorporated entirely herein by reference.

BACKGROUND

1. Technical Field

Aspects of this document relate generally to pin-back buttons, such as commemorative buttons for events.

2. Background Art

Conventionally, pin-back buttons are used to advertise or commemorate an event. A pin-back button has a first side that is designed to show a message, typically covered under a plastic covering and a second side (back) that faces a user that includes a pin used to attached the pin-back button to clothing worn by the user.

SUMMARY

Implementations of button holders may include: a planar portion having a hole therethrough, one or more flanges configured to receive a pin-back button, the one or more flanges located around at least a portion of a perimeter of the hole on opposing sides of the hole and a messaging portion coupled on the planar portion above, below, or both above and below the hole. The flanges may be configured to removably couple to the button through a friction fit. The hole may be configured to allow a pin of the pin-back button to be accessible through the hole by a user to allow the pin to couple to user's clothing.

Implementations of button holders may include one, all, or any of the following:

At least two flanges may be located around the perimeter of the hole, one above the hole and one below the hole.

Implementations of button holders may also include: a planar portion having a hole therethrough, two flanges around a portion of the perimeter of the hole on opposing sides of the hole, the flanges configured to receive a pin-back button having a front and a back, the back having a pin and a messaging portion located on the planar portion above and below the hole. The flanges may be fixedly coupled to the pin-back button. The messaging portion may be displayed above and below the button. The pin of the pin-back button may be positioned through the hole to allow the button holder and the button to be secured to the user's clothing.

Implementations of button holders may also include: a planar portion with a hole therethrough, two flanges around a portion of the perimeter of the hole on opposing sides of the hole, the flanges configured to receive a pin-back button having a front and a back, the back having a pin and a messaging portion located on the planar portion above and below the hole. The flanges may be fixedly coupled to the pin-back button. The messaging portion may be displayed above and below the button. The pin of the pin-back button may be positioned through the hole to allow the button holder and the button to be secured to the user's clothing.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended button holder will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such button holders, and implementing components and methods, consistent with the intended operation and methods.

Figure 1:
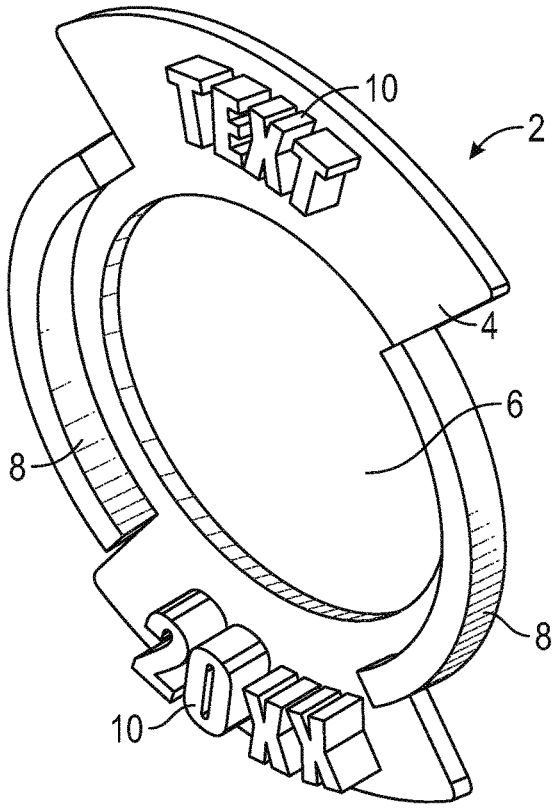
FIG. 1 is a perspective view of a button holder.

FIG. 1 illustrates a perspective view of an implementation of a button holder 2. The planar portion 4 of the device has a hole 6 therethrough. The one or more flanges 8 are located around at least a portion of a perimeter of the hole 6 on opposing sides of the hole 6. The flanges 8 are configured to receive a pin-back button. The flanges 8 are configured to removably couple to the pin-back button through a friction fit as the edge of the pin-back button slidably engages with the surface of the flanges 8. The messaging portion 10 is coupled on the planar portion 4 above and below the hole 8. The messaging portion 10 may be two or three-dimensional and may include any type of writing, graphic, lettering, etc.

Figure 2:
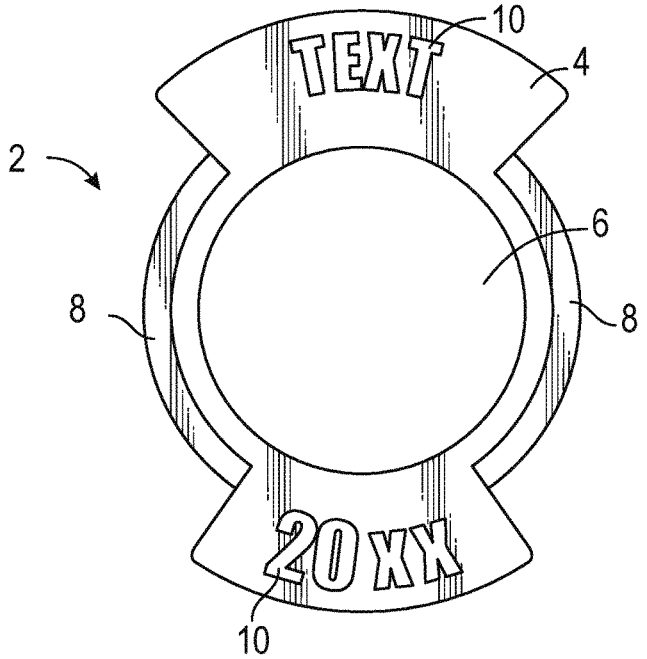
FIG. 2 is a front view of a button holder.

Referring to FIG. 2, a front view of an implementation of the button holder 12 is illustrated. The flanges 8 are connected to the planar portion 4 of the button holder 2. The flanges 8 are located around the hole 6 of the button holder 2. The one or more flanges 8 may be located around the perimeter of the hole 6, one above the hole 6 and one below the hole 6. In various implementations, the one or more flanges 8 may be a single flange that extends all the way around the perimeter of the hole 6. In other implementations, however, two, three, four, five, or any number of flanges/projections/pin-shaped structures may be used to couple to the pin-back button. The messaging portion 10 is coupled to the planar portion 4 of the button holder 2. The messaging portion 10 may be above the hole 6, below the hole 6 and both above and below the hole 6.

Figure 3:
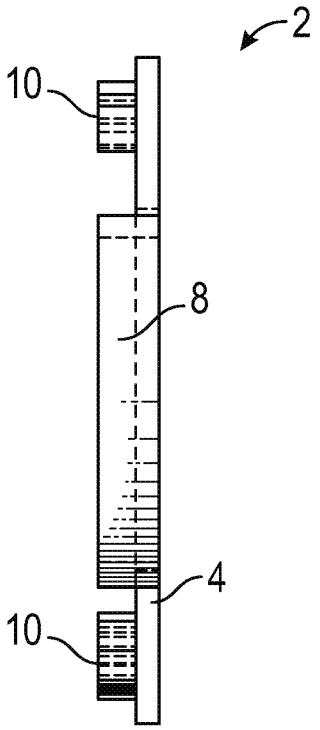
FIG. 3 is a side partial see-through view of a button holder.
Figure 4:
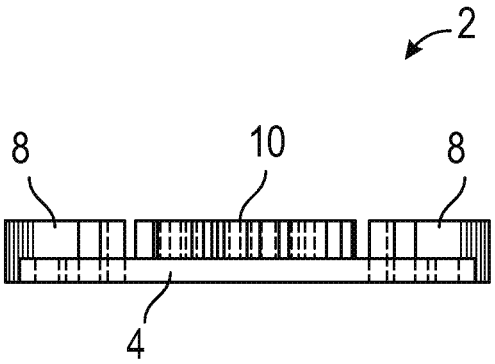
FIG. 4 is a top view of the button holder.

Referring to FIG. 3, a side partial see-through view of an implementation of the button holder 2 is illustrated. In this view the planar portion 4 of the button holder is illustrated. This view also illustrates where the flanges 8 are located on the surface of the planar portion 4 of the button holder 2. The message portion 10 of the button holder 2 is also illustrated on the top and bottom of the planar portion 4. Referring to FIG. 4, a top view of the button holder 2 is illustrated. The flanges 8 as coupled to the planar portion 4 are also illustrated. The position of the message portion 10 on the planar portion 4 is also illustrated.

Figure 5:
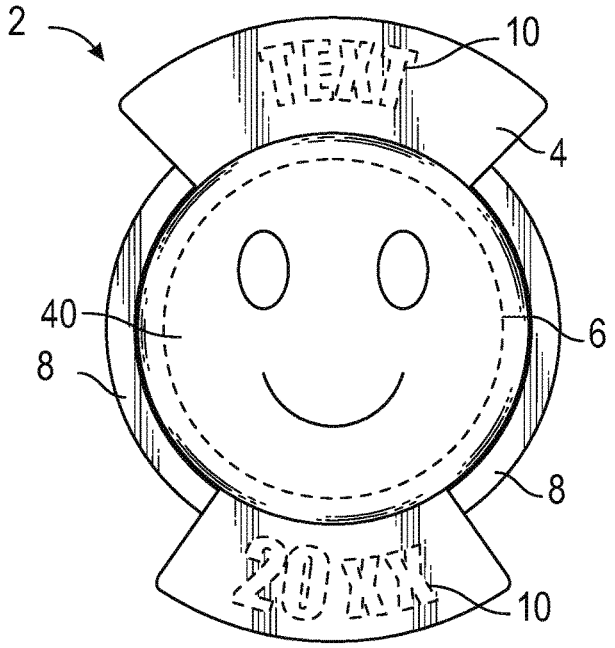
FIG. 5 is a front view of the button holder with the flanges of the holder coupled to a pin-back button.
Figure 6:
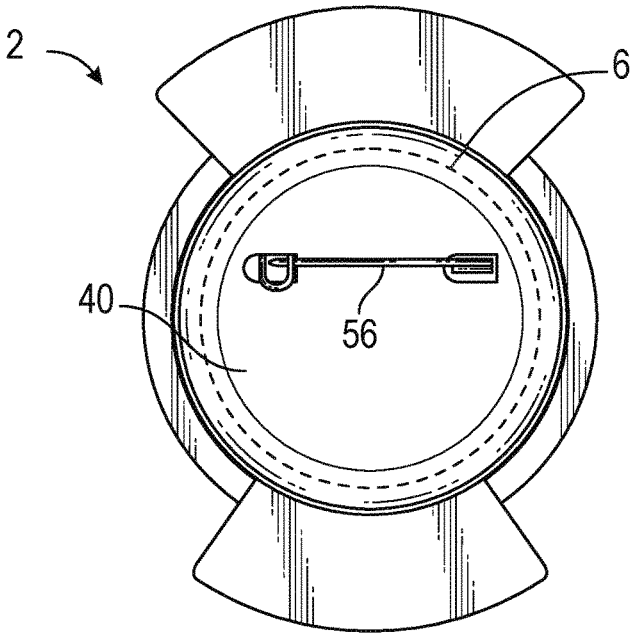
FIG. 6 is a back view of the button holder showing the pin of the pin-back button that is coupled to the button holder.

Referring to FIG. 5, a front view of the button holder 2 coupled to a pin-back button 40 is illustrated. The flanges 8 are configured to fixedly couple to the pin-back button 40 through a friction fit as the button 40 is inserted into the space formed by the flanges 8. The message portion 10 is then displayed above and below the pin-back button 40 on the planar portion 4 of the button holder 2. The pin-back button 40 is positioned through/extends through the hole 6 to allow the button holder 2 and the pin-back button 40 to be secured to the user's clothing and to display the messaging portion 10 around the pin-back button 40. Referring to FIG. 6, a back view of the button holder 2 coupled to a pin-back button 40 is illustrated. The back of the pin-back button 40 is visible through the hole 6. The pin 56 of the pin-back button 40 is accessible through the hole 6 to allow the pin 56 to couple to the user's clothing.

The button holder can be used in a number of different situations to customize a pin-back button made for an event to a particular user through changes to the messaging portion and/or the color/shape/design of the planar portion 4. By non-limiting example, a pin-back button can be made for a school group and the button holder can include a message distinguishing the user, for example, as the President of the group. Similarly, a pin-back button can be made as a souvenir for a party, such as a family reunion, and the button holder can include a message with the user's first name and/or hometown. The button holder can also be used for a wedding party. For example, all guests may receive a pin-back button and members of the bridal party receive a button holder distinguishing them as the "Maid of Honor," "Best Man," "Ring Bearer," etc. In this way the button holder acts as both a way to identify members of the bridal party for other guests and as a keepsake for the members of the bridal party. The button holder can also be customized to include the date of an event when one pin-back button design is used for multiple events. The button holder can also be used for sporting teams as a keepsake at year-end parties.

In places where the description above refers to particular implementations of a button holder and implementing components, sub-components, methods and sub-methods, it should be readily apparent that a number of modifications may be made without departing from the spirit thereof and that these implementations, implementing components, sub-components, methods and sub-methods may be applied to other button holders.

What is claimed is:

1. A button holder consisting of:

a planar portion having a hole therethrough;

two flanges around a portion of a perimeter of the hole on opposing sides of the hole, the flanges configured to receive a pin-back button having a front and a back, the back having a pin; and a messaging portion located on the planar portion above and below the hole;

wherein the flanges fixedly couple to the pin-back button;

wherein the messaging portion is displayed above and below the button; and wherein the pin of the pin-back button is positioned through the hole to allow the button holder and the pin-back button to be secured to a user's clothing.

2. In a pin-back button having a front and a back with a design on the front and a pin on the back, an improvement comprises:

a planar portion with a hole therethrough;

one or more flanges sized to receive the pin-back button and surrounding at least a portion of a perimeter of the hole, the one or more flanges securing the button within the hole through a friction fit;

a messaging portion located above and below the hole;

wherein the pin of the pin-back button is configured to extend through the hole; and wherein the hole allows the pin of the pin-back button to be secured to clothing worn by a user to secure the planar portion and the pin-back button to the clothing and to display the messaging portion around the pin-back button.

* * * * *